US005753925A

United States Patent [19]

Yamanaka et al.

[11] Patent Number: 5,753,925

[45] Date of Patent: May 19, 1998

[54] RADIOACTIVE WASTE STORAGE FACILITY

[75] Inventors: Tsuneyasu Yamanaka, Hitachinaka; Masami Matsuda, Hitachi; Hidetoshi Kanai, Jyuou-machi; Takao Ganda, Hitachi, all of Japan

[73] Assignee: Hitachi, Ltd., Tokyo, Japan

[21] Appl. No.: 494,349

[22] Filed: Jun. 26, 1995

[30] Foreign Application Priority Data

Jun. 29, 1994 [JP] Japan ..... 6-147355

[51] Int. Cl.[6] ..... G21F 5/00

[52] U.S. Cl. ..... 250/507.1; 250/506.1; 252/636

[58] Field of Search ..... 250/507.1, 506.1, 250/505.1, 515.1; 376/272; 252/636, 644

[56] References Cited

U.S. PATENT DOCUMENTS 4,328,423 5/1982 Lorenzo et al. ..... 250/506.1
4,476,394 10/1984 Müller et al. ..... 250/506.1
4,498,011 2/1985 Dyck et al. ..... 250/507.1
4,625,122 11/1986 Botzem et al. ..... 250/506.1
4,827,139 5/1989 Wells et al. ..... 250/507.1
4,834,916 5/1989 Chaudon et al. ..... 250/507.1
5,063,299 11/1991 Efferding ..... 250/507.1

*Primary Examiner*—Kiet T. Nguyen

*Attorney, Agent, or Firm*—Antonelli, Terry, Stout, & Kraus, LLP

[57] ABSTRACT

Horizontal partition wall 10 is disposed between ceiling slab 9 and floor slab 8. A plurality of storage tubes 6 each accomodating canister 2 are hanging from ceiling slab 9, and penetrate horizontal wall 10 to extend towards floor slab 8. Cooling passages are formed between horizontal partition wall 10 and ceiling slab 9 and between horizontal partition wall 10 and floor slab 8. Cooling air flowing through each of the cooling passages cools down storage tubes 6.

25 Claims, 8 Drawing Sheets

RADIOACTIVE WASTE STORAGE FACILITY

DETAILED DESCRIPTION OF THE INVENTION

1. Field of the Invention

This invention is related to a dry storage facility for radioactive materials, in particular to a radioactive waste dry storage facility which is suitable for storage of high level radioactive materials from spent fuels, etc. occurring from a nuclear power plant.

2. Description of Prior Art

High level radioactive waste which are residues of reprocessed spent fuel assemblies occur from a nuclear power plant. The residues after having been stabilized as a vitrification body are packed in a canister and are stored for a long time in a radioactive waste dry storage facility. The radioactive waste storage facility is described in Japanese patent laid-open print No. 2-17500 bulletin. A number of cylindrical steel sleeves (storage tubes) are arranged in the canister storeroom, the storage tubes having such a length that several canisters can be stacked therein. Decay heat from the vitrification body in the canisters is cooled by air flowing through a cooling air passage formed between a ceiling slab which holds an upper end of the steel sleeves and a floor slab which is located underneath the ceiling slab and holds an lower end of the steel sleeves.

The cooling air that is led into a cooling air passage is open air taken into from outside of the radioactive waste dry storage facility. Supply of cooling air is carried out by natural ventilation.

The radioactive waste dry storage facility shown in Japanese utility model patent laid-open print No. 62-22600 bulletin is the same as Japanese patent laid-open print No. 2-17500 bulletin. The canisters accomodating a vitrification body of high level radioactive waste are stacked in a bottomed cylindrical pit (storage tube). The upper end of this bottomed cylindrical pit is supported by the upper slab and its lower end is supported by a lower slab located underneath the upper slab. The cooling passages through which cooling air flows are arranged so as to surround the bottomed cylindrical pit.

Decay heat occurring from the vitrification body in the bottomed cylindrical pit is cooled by air flowing upwardly through the inside of the cooling passages. Supply of cooling air to inside of cooling passages is carried out by natural ventilation.

In the radioactive waste dry storage facility shown in Japanese patent laid-open print No. 3-273193 bulletin, canisters for storing spent fuel assemblies are stacked in a storage tube. The cooling passage which directs upwardly cooling air taken into from outside of the dry storage facility is formed in the circumference of the storage tube between sheaths surrounding the accomodating tube as same as Japanese utility model patent laid-open print No. 62-22600 bulletin. The storage tube is supported by a ceiling slab. Supply of cooling air to inside of the cooling passage is carried out by natural ventilation. Furthermore, forced ventilation means for sucking open air by a blower in the storage tube is disposed.

In order to reduce a area of the radioactive waste dry storage facility, canisters have been stacked in the storage tube as disclosed in the above-mentioned laid-open prints. As an increase in the stacked number of canisters the area necessary for the dry storage facility decreases.

However, the radioactive waste dry storage facility shown in Japanese patent laid-open print No. 2-17500 bulletin has a drawback that a temperature of cooling air above the cooling air passage rises when a stacking number of canisters increases. In other words, the cooling air which flows through inside of the cooling air passage extending in a horizontal direction and formed between the ceiling slab and the floor slab is heated by removing decay heat of radioactive waste in the canisters. This heated cooling air rises in a direction of the upper part of the cooling air passage. On this account, the upper temperature of the cooling air passage rises. This restrains cooling of radioactive waste in the canisters located in an upper part of the storage tube, and also restrains an increase of the stacking number of canisters.

As disclosed in Japanese utility model patent laid-open print No. 62-22600 bulletin and Japanese patent laid-open print No. 3-273193 bulletin, a pressure loss in the cooling passage, which has a small inner diameter, increases as the number of stacking of the canisters, when a cooling passage surrounding the circumference of the storage tube with a circular body is formed between the storage tube and the circular body, thereby to guide cooling air upwardly.

An increase of such pressure loss lowers a quantity of an inflow of cooling air to inside of the cooling passage. In particular, because supply of the cooling air is not carried out forcefully with a blower, but is carried out with natural power, an increase of pressure loss gives influence on lowering of a quantity of supplying cooling air. Therefore, an increase of the pressure loss acts as restraining an increase of the stacking number of canisters. Since the circular body needs to be disposed to form a circular cooling passage in a circumference of storage tubes, the storage facility shown in Japanese utility model patent laid-open print No. 62-22600 bulletin and Japanese patent laid-open print No. 3-273193 bulletin becomes more complicated than that shown in Japanese patent laid-open print No. 2-17500 bulletin.

SUMMARY OF THE INVENTION

An object of this invention is to provide a radioactive waste dry storage facility which has a more constant temperature distribution in an axial direction of the storage tubes and has a simple construction.

Another object of this invention is to provide a dry storage facility that can cool canisters efficiently.

Another object of this invention is to provide a dry storage facility with the storage tube of improved earthquake proof.

Another object of this invention is to provide a dry storage facility of which thermal stress in the storage tubes can be relaxed.

Another object of this invention is to provide a dry storage facility which can prevent the damage by thermal expansion in the axial direction of the storage tube.

Another object of this invention is to provide a dry storage facility that can restrain deformation of the storage tube by collision at the time of earthquakes.

Another object of this invention is to provide a dry storage facility which can restrain transfer of heat between the cooling passages in a horizontal direction.

Another object of this invention is to provide a dry storage facility which can make more uniform the temperature distribution in the storage tubes.

A feature of the present invention to accomplish the object of the present invention resides in arranging a cooling gas passage between a first slab and a second slab, the cooling gas passage being divided into a plurality of sections in upper and lower directions, and a partition member which penetrates storage tubes being disposed between the first slab and the second slab.

Another aspect of the present invention resides in setting a height of each of the cooling passages to be equal to that of a canister.

Another aspect of the present invention resides in disposing a vibration limiting member to the second slab at the circumference of the lower end of the storage tube, the vibration limiting member controlling vibration in a transverse direction of the lower end of the storage tube.

Another aspect of the present invention resides in forming a gap between the partition member and the storage tube.

Another aspect of the present invention resides in forming a space that can absorb the thermal expansion of the storage tube in the axial direction between the lower edge of the storage tube and the second slab.

Another aspect of the present invention resides in providing a pad on the partition member and the vibration limiting member at an opposite position.

Another aspect of the present invention resides in installing a deformable supporting member for restraining vibration of the storage tube in the horizontal direction, the supporting member being disposed to the partition member and the storage tube.

Another aspect of the present invention resides in forming a partition member of a thermal insulation material.

Another aspect of the present invention resides in disposing a convection restraint member between canisters accomodated in the storage tube in the axial direction of the storage tube.

Another aspect of the present invention resides in forming an element that is disposed in the storage tube as a partition member.

Another aspect of the present invention resides in disposing flow quantity regulation means for regulating a flow quantity of the cooling gas to each of the cooling passages.

Another aspect of the present invention resides in forming storage tubes whose sectional shape is polygonal, wherein corners of the sectional shape of the tubes are arranged in the direction of the entrance of the cooling passage.

Another aspect of the present invention resides in forming the storage tubes that have a square or a hexagonal sectional shape.

Another aspect of the present invention resides in forming a canister having a sectional shape of a similar shape with that of the storage tubes.

Another aspect of the present invention resides in providing means for maintenance and inspection of the outside of the storage tube, wherein the maintenance and inspection means move between the storage tubes in the cooling passage.

Another aspect of the present invention resides in disposing means for cleaning the inside of the intake pit of cooling air, the intake pit for cooling air communicating an entrance of the cooling passage and the atmosphere.

Another aspect of the present invention resides in a canister comprising a container, which has an opening at the top of the container, for accomodating radioactive waste therein and a lid for sealing the top end of the container, wherein the sectional shapes of the container and the lid are a poligonal form.

Another aspect of the present invention resides in forming a container and a lid both of which are made of a boron containing alloy amterial.

Another aspect of the present invention is to provide a method, which comprises, taking canisters in which the radioactive waste is sealed out from the storage tubes, loading the canisters in a transportation cask, and transferring the transportation cask to outside a radioactive waste dry storage facility.

Another aspect of the present invention resides in accomodating the canisters from the storage tubes located at the outlet side of a cooling gas passage to the storage tubes located in the inlet side of the cooling gas passage.

Another aspect of the present invention resides in arranging the first canister that accomodates radioactive waste below the storage tube and arranging the second canister that accomodates radioactive waste which generate less heat than the radioactive waste in the first canister above the first canister.

When a partition member is disposed between the first slab and the second slab, cooling gas moves in cooling passages formed by the partition member, entering of cooling gas into the passage below the partion member into the passage above the partition member is sufficiently restrained. As a result, a temperature rise of cooling gas in the passage above the partition member is controlled, and cooling of the storage tubes is effectively performed in the upper passage. A temperature distribution in the axial direction of the storage tubes can be uniformalized by the simple structure. In particular, it is possible to load more canisters than the radioactive waste dry storage facility shown in Japanese patent laid-open print No. 2-17500 bulletin.

When a height of each of the cooling passages is the same as that of canisters, cooling of the canisters in the direction of its height is not hindered, and cooling of the canisters can be performed with high effeciency. If the partition member is arranged at the position crossing the canisters, cooling gas flowing through inside of the cooling passage does not come directly to the storage tubes facing the partition member, and as a result, cooling of this part is obstructed.

If the canisters are located at a position intersecting with the partition member in the storage tubes, cooling of this intersecting part is obstructed by the partition member. This invention solves such problem.

When vibration limiting means for controlling vibration in the transverse direction of the lower end of the storage tubes is disposed to the second slab, vibration of lower end of the storage tubes in an earthquake can be restrained so that earthquake-proof of the storage tubes can be improved.

When a small amount of cooling gas flows into the cooling passage above the partition member from the cooling passage below the partition member through the gap formed between the partition member and the storage tube, a temperature difference between the upper and lower passages becomes small. Therefore, a thermal stress occurring in the penetration of the partition member in the storage tubes is relaxed.

When a space for absorbing a thermal expansion of the storage tube in the axial direction is formed between the lower end of the storage tube and the second slab, the storage tube can expand downwardly at the time when the storage tube is heated by decay heat of radioactive waste. Therefore, the damage by breakage of the storage tubes can be prevented.

When pads are disposed at positions of the storage tubes where pads face the partition member and the vibration limiting member, the strength of the positions can be increased, and deformation of the storage tubes that is caused by collision of the partition member and the vibration limiting means at the time of earthquakes.

When a deformable supporting member is disposed between the partition member and the storage tubes, vibration of the storage tubes in the transverse direction is prevented, and anti-earthquake property of the storage is increased.

The partition member made of a thermal insulating material restrains the heat conduction of heat of cooling gas in the lower cooling passage to cooling gas in the upper passage above the partition member. Accordingly, it is impossible to limit a temperature rise of the cooling gas in the upper passage.

When convection restraint members are disposed between a plurarity of canisters accomodated in the axial direction of the storage tubes, gas convection caused by heating by decay heat of radioactive waste is restricted to the area where one canister is disposed. As a result, a temperature rise in an upper part of the storage tube is restrained, and a temperature distribution in the axial direction of the storage tube becomes more constant.

Because the partition member is constituted by partition elements disposed in storage tubes, the partition members are not necessary for the storage plant, and the structure of the facility can be simplified.

When flow quantity regulation means for controlling a flow quantity of cooling gas is disposed to each of the cooling passages, the temperature distribution in the axial direction of the storage tubes can be easily regulated to be constant, even when there is an unbalance in the axial direction of the storage tubes.

When corners of the polygonal storage tubes are arranged towards an entrance of the cooling passage, resistance to the flow of cooling gas decreases and a pressure loss of cooling passage can be reduced.

When the sectional shape of the storage tubes is formed in a square or hexagonal shape, flow of contracted vein between adjacent storage tubes does not occur, and it is possible to form cooling passages with less stay of gas flow. On this account, cooling ability of the storage tubes can be improved.

Because a sectional shape of the canister accomodated in the storage tubes is similar figure of that of the storage tubes, a gap width formed between the storage tubes and the canister is constant, and it is possible to improve the cooling efficiency of the radioactive materials.

When maintenance and inspection means that moves in the cooling passages between the storage tubes is disposed, maintenance ans inspection of the outer face of the storage tubes can be carried out easily.

When a cooling air intake pit which communicates an entrance of each of the cooling passages and the atmosphere is provided with cleaning means, it is possible to remove alien substances collected in this passage communicating each of the cooling passages and the atmosphere.

Because the sectional shapes of the container and the lid are polygonal, a useless space in the canister for accomodating a used fuel assembly that has a polygonal sectional shape can be reduced. On this account, the space efficiency of the canister can be increased.

When the container and the lid are made of boron containing alloys, a criticality management of the accomodated used fuel assembly in the container becomes easy.

When a sealed-up canister accomodating radioactive waste is loaded in a transportation cask is carried out the dry storage facility for radioactive waste, re-loading of the radioactive waste in the canister to the transportation cask is not necessary at the time of transfer of the canister, and carrying out of the radioactive materials in the storage tube can be carried out in short time.

When the canisters are loaded one by one in the storage tubes from the storage tube located near the outlet of the cooling gas passage towards the storage tube located near the inlet side, the canister accomodating radioactive waste that are just carried into the dry storage facility and have a great heat generation is loaded in the storage tube located atmost upper stream side. Accordingly, radioactive waste with big quantity of heat generation in this storage tube are cooled with high effeciency by cooling gas with low temperature.

When a long time has passed since the radioactive waste accomodated in the storage tube near the outlet side of the cooling gas passage, such the waste have a small heat generation. Accordingly, the storage tube at lower stream side can be cooled by cooling gas whose temperature is elevated after cooling the storage tube at upper stream side.

When a canister accomodating radioactive waste with a smaller heat generation than that of a canister arranged at the lower position of the storage tube is loaded at the upper position of the storage tube, a temperature at the top of the storage tube can be lowered. Further, a temperature of cooling gas in the upper position of the gas passage can be lowered.

DETAILED DESCRIPTION OF THE PREFERRED EMBODIMENTS

Figure 1:
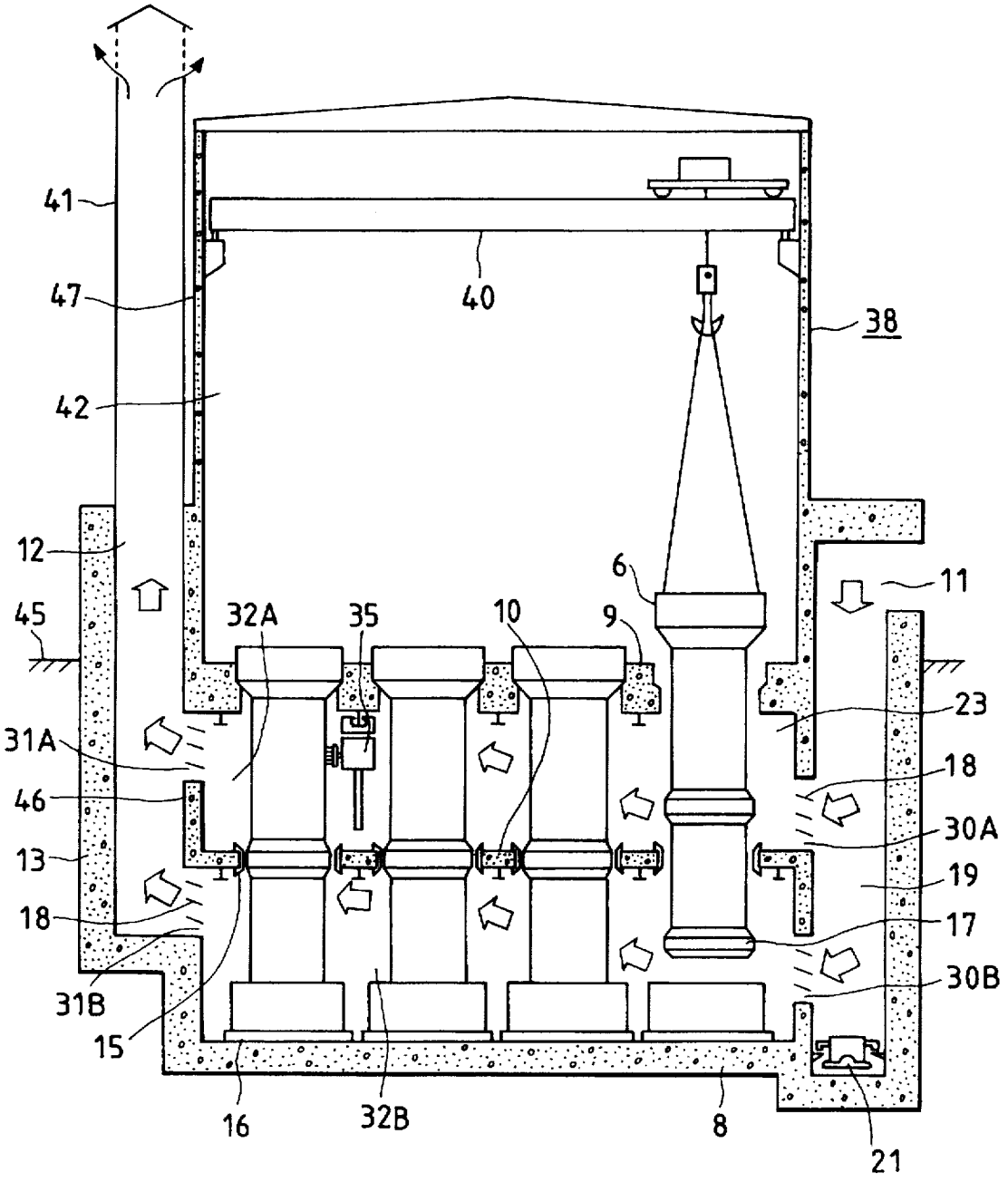
FIG. 1 is a vertical sectional view of one example of a dry radioactive waste storage facility facility according to the present invention.
Figure 2:
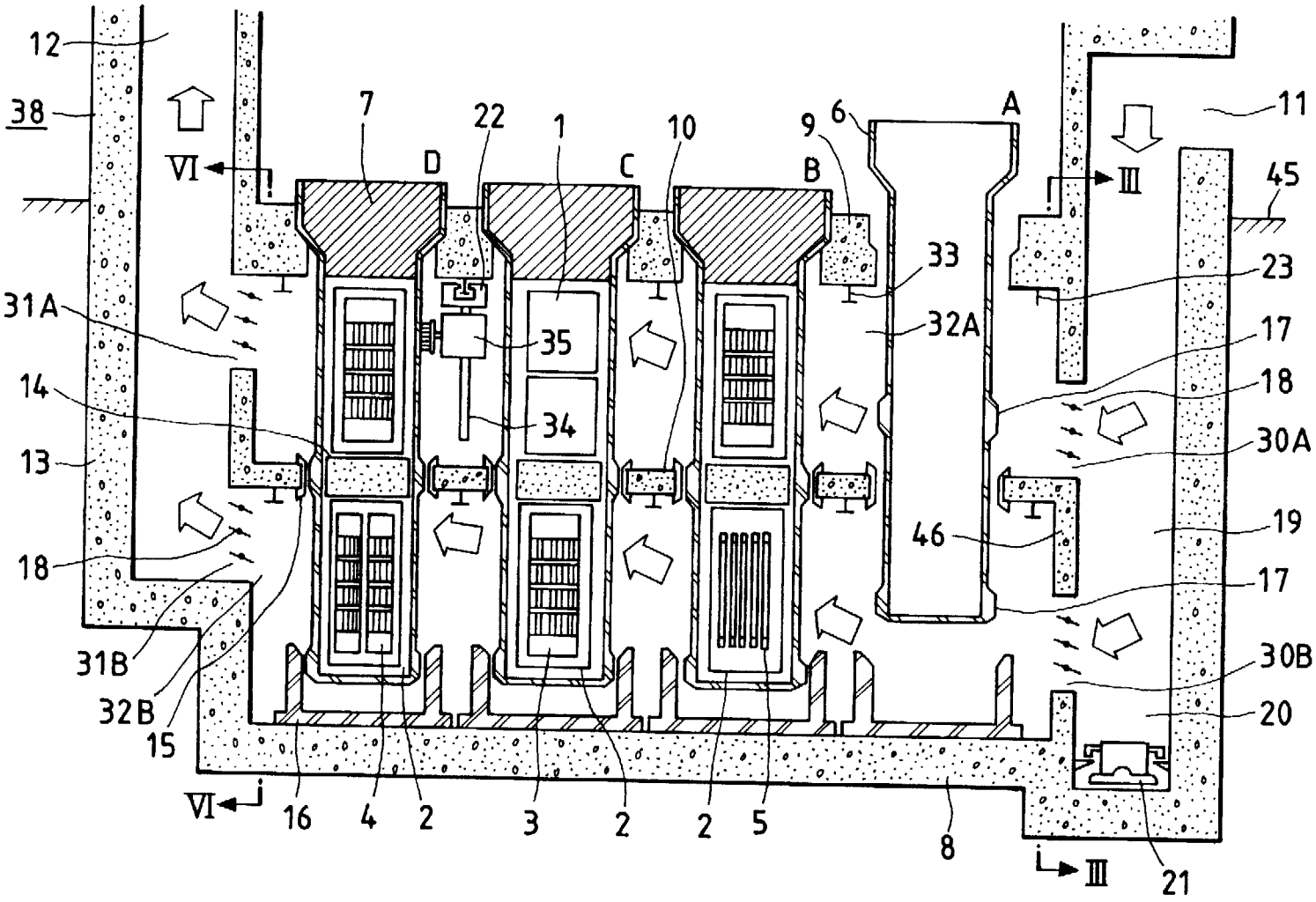
FIG. 2 is a enlarged vertical sectional view of a part around a canister room.

A dry storage facility for the radioactive masterials which is a preferred example of this invention is explained by FIGS. 1, 2, 3 and 4. The dry storage facility for radioactive materials has following elements.

The dry storage facility 38 comprises outer wall 13 the dominant part of which is located underground, floor slab 8 constituting a bottom of outer wall 13, ceiling slab 9 that is located above floor slab 8, outer wall 47 that is located above ground 45, inner wall 46 located in outer wall 13 and horizontal partition wall 10. Ceiling slab 9 and horizontal partition wall 10 are installed to inner wall 46. Horizontal partition wall 10 is located between ceiling slab 9 and floor slab 8, more precisely in the middle point therebetween. Outer wall 47 is installed at the upper position of inner wall 46.

Canister transfer room 42 is formed in outer wall 47 above ceiling slab 9. Canister transfer room 42 is covered by ceiling part installed to outer wall 47. Ceiling traveling crane 40 is installed in canister transfer room 42 and is installed on the travelling rails disposed to outer wall 47.

Entrance duct 19 is opened to the atmosphere outside of dry storage facility 38 through air intake port 11 formed between outer wall 13 and inner wall 46. Air discharge duct 12 is disposed at a position opposite to entrance duct 19 between outer wall 13 and inner wall 46. Air discharge duct 12 is communicated with the atmosphere outside of storage plant 38 through a passage in exhaust pipe 41.

The inner area of inner wall 46 below ceiling slab 9 is canister storeroom. A plurality of storage tubes 6 for storing canisters therein are disposed in the canister storeroom. The canister storeroom is divided into two cooling passages by horizontal partition walls 10. One of them is cooling passage 32A formed between ceiling slab 9 and horizontal partition wall 10. The other is cooling passage 32B formed between horizontal partition wall 10 and floor slab 8.

Figure 3:
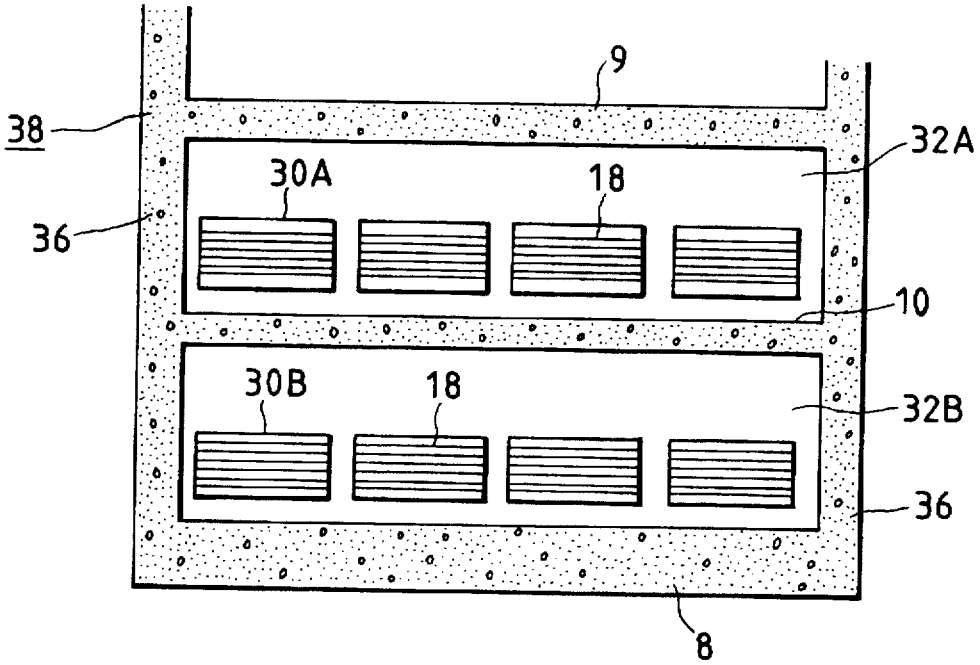
FIG. 3 is a sectional view along the III—III line of FIG. 2.
Figure 4:
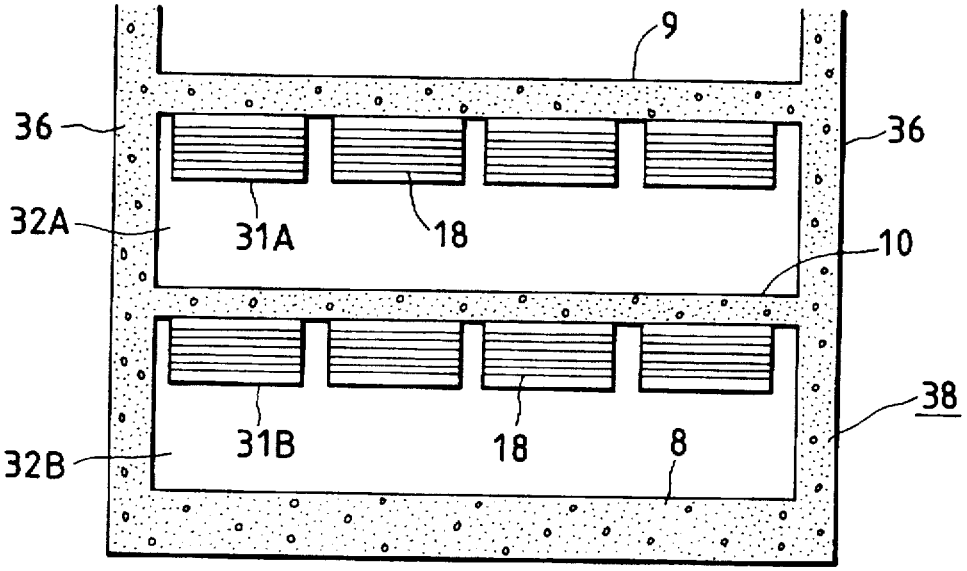
FIG. 4 is a sectional view along the IVI—IVI line of FIG. 2.

Cooling passage 32 A is communicated with entrance duct 19 through entrances 30, and is further communicated with air discharge port 12 through outlet openings 30A disposed opposite to inner wall 46. Cooling passage 32B located below cooling passage 32A is communicated with air discharge duct 19 through entrance openings 30B formed in inner wall 46, and is further communicated with air discharge port 12 through outlet openings 31B. As shown in FIGS. 3 and 4, each of cooling passage 32A, 32B is a part of outer wall and is located between a pair of side walls 36 that intersect inner wall 46. Lubers 18 are rotatably disposed to entrances 30A and 30B, and exit openings 31A and 31B. Lubers 18 are rotated by a motor, not shown.

Each storage tube 6 that is hanging from ceiling slab 9 penetrates horizontal partition wall 10. Each storage tube 6 is extending in cooling passage 32B and crossing the cooling passage 32 in upper and lower directions. Circular shaped vibration limiting member 16 is disposed to the upper face of floorslab 8. The lower end of storage tube 6 is inserted into vibration limiting member 16. Pad 17 is disposed to storage tube 6 at a position facing the horizontal partition wall 10 and vibration limiting member 16. A thickness of pad 17 is larger than the other part of storage tube 6.

Storage tube 6 hanging from ceiling slab 9, as shown by A in FIG. 1, is removable upwardly by ceiling traveling crane 40. An inclined face having a funtion of a guide is formed in the inside of the upper end of vibration limiting member 16, so that the lower end of storage tube 6 is smoothly inserted into vibration limiting member 16.

A sectional shape of storage tube 6 is shaped is circular. Storage tubes 6 are arranged in a array form of equilateral triangle, on the horizontal section of the canister storeroom.

Horizontal partition wall 10 has a plurality of circular openings through which storage tubes 6 penetrate. These openings are arranged in a array form of equilateral triangle in the similar arranging pitch to that of storage tubes 6. Middle vibration limiting member 15 is disposed to horizontal partition wall 10 so as to face pad 17 of storage tube 6. Middle vibration limiting member 15 has an inclined face for guiding storage tubes 6 in its inner face. A gap is formed between an outer face of pad 17 and middle vibration limiting member 15. A width of this gap is slightly bigger than that a thermal expansion of pad 17 in radial direction. A gap formed between pad 17 located at the lower edge of storage tube 6 and vibration limiting member 16 has a width which is slightly bigger than a thermal expansion of pad 17 in radial direction.

A robot for maintenance and inspection travels along the traveling rail 33 disposed between storage tubes 6 underneath ceiling slab 9 and horizontal partition wall 10. The robot is provided with running truck 22 involved to traveling rail 33, vertical guide rail 34 extending underneath running truck 22 and maintenance and inspection section 35 moving up and down along vertical guide rail 34.

Pit 20 is disposed at a lower end of entrance duct 19. Cleaning robot 21 is installed inside of pit 20.

Radioactive wastes such as the vitrificated high level radioactive waste 1, large size spent fuel assembly 3 from a pressureized water type reactor that is sealed up in canister 2, small size spent fuel assembly 4 from a boiling water type nuclear reactor that is sealed up in canister 2, and spent fuel rods 5 that are disassembled from a spent fuel assembly and sealed up in canister 2 are stored in storage tubes 6. Storage tubes 6 can be sealed up by storage lid 7 after canisters 2, etc. are loaded therein. Storage tubes 6 are removable upwardly from ceiling slab 9, thereby to be useful for exchanging and inspection. As exemplified by B to D in FIG. 1, not only one kind of radioactive waste is stored in storage tubes 6, but also various kinds of radioactive waste can be stored.

Partition board 14 made of thermal insulating material is arranged between canisters 2 loaded in each storage tube 6. The arranging level of partition boards 14 is the same as that of horizontal partition wall 10. Partition board 14 may be boards of stainless steel or ceramics. In order to restrain convection in storage tube 6, partition board 14 is formed larger than the width of canister 2 and vitrificated body 1. An upper end of storage tube 6 where canister 2 etc. is acommodated is sealed up by storage cover or lid 7.

Open air taken in from port 11 flows entrance duct 19 as cooling air, and enters into cooling passages 32A, 32B through entrances 30A, 30B. Cooling air passing between storage tubes 6 and entering into each of cooling passages 32A, 32B is lead to air discharge duct 12 through exit openings 31A, 31B. This cooling air is discharged outside of dry storage facility 38 flowing through exhaust pipe 41. This flow of cooling air is not effected forcefully by a blower, but is occurred naturally by chimney effect of exhaust pipe 41. Decay heat of radioactive materials accomodated in canister 2 in storage tube 6 is cooled by natural cooling.

In this example, cooling air flows through inside of each of cooling passages 32A and 32B that is formed by disposing horizontal partition wall 10 between ceiling slab 9 and floor slab 8. Cooling air heated in the lower cooling passage 32B is remarkably suppressed by horizontal partition wall 10 from rising into the upper cooling passage 32A.

Namely, it is possible to restrain a temperature rise of cooling air in cooling passage 32A, wherein the temperature rise is caused by entering of warmed cooling air in the upper part of cooling passage 32B into cooling passage 32A. Therefore, cooling of storage tubes 6 is effectively carried out in cooling passage 32A, too.

In this example, the temperature distribution in the axial direction of storage tubes 6 can be made more constant, compared with the dry storage facility disclosed in Japanese patent laid-open print NO. 2-17500, by such a simple structure as disposing a horizontal partition wall 10. This leads to an increase in a number of stacks of canisters, compared with the dry storage facility disclosed in Japanese patent laid-open print NO. 2-17500. Horizontal partition wall 10 not only makes the temperature distribution constant, but also suppreses horizontal vibration at the middle point of the height of storage tubes 6. Therefore, resistance to earthquakes of storage tubes 6 increases. Moreover, middle vibration limiting member 15 restrains the horizontal vibration of the tubes 6.

A height of each of cooling passages 32A, 32B is substantially the same as that of canister 2. When cooling air comes in contact with portions of storage tubes 6 where canister 2 is located, cooling of canister 2 is not hindered by horizontal partition wall 10. Cooling of canister 2 that is heated by decay heat of stored radioactive waste effectively carried out. If horizontal partition wall 10 is located at a position to cross canister 2, cooling air flowing the cooling passage does not directly in contact with a position of storage tubes 6 facing horizontal partition wall 10, and cooling of this position is hindered.

Since horizontal partition wall 10 is made of concrete which is thermal insulating, it restrains thermal conduction of heat of cooling air in cooling passage 32B, especially heat of cooling air at the upper position of cooling passage that has a higher temperature to cooling air in cooling passage 32A. Accordingly, the temperature increase of cooling air in cooling passage 32A is suppresed, and cooling of storage tubes 6 in cooling passage 32A is carried out with high efficiency. Horizontal partition wall 10 may be constituted by members of stainless steel plates that has a small thermal conductivity or a thermal insulating material and earthquake-proof material.

A small amount of cooling air flows into cooling passage 32A from lower cooling passage 32B through a gap formed between middle vibration limiting member 15 disposed to horizontal partition wall 10. This air flow reduces thermal stress occurred in penetration position where horizontal partition wall 10 penetrates storage tubes 6 by cold cooling air in contact with the upper face of horizontal partition wall 10 and warm cooling air in contact with the upper face of horizontal partition wall 10. When an amount of air flowing the gap becomes larger, an air temperature at the upper position of cooling passage 32A rises. Therefore, the sectional area of the gap must be properly chosen.

In this example, since lubers 18 are disposed at an entrance and exit of each of the cooling passages, amounts in cooling passages 32A, 32B are controlled by adjusting angles of lubers 18. Even if unbalance in temperature distribution in axial direction of storage tubes 6 arranged over different cooling pasages appears, the temperature distribution can be made constant by adjusting the louver angles. Although not shown in the drawings, louver angles can be adjusted by measuring temperatures of cooling passges 32A, 32B and controlling a stepping motor pulse number in response to the measured temperature.

It is known that the metal becomes brittle material at low temperatures. When the radioactive waste storage dry plant is constructed in a northern area, there is a need to control an intake amount of air from outside in order to avoide low temperature brittleness of storage tubes 6 due to super cooling. Even if there is unbalance between heat generation of radioactive waste accomodated in canister 2 located in cooling passage 32A and that of radioactive waste accomodated in canister 2 located in cooling passage 32B, amounts of cooling air in cooling passages 32A, 32B are independently controlled by adjusting angles of louvers 18.

When an amount leaked air from the gap for releifing stress occurred at the penetration position increases, balance between cooling air in cooling passage 32A, 32B becomes improper. In order to remove this inconvenience, angles of louvers 18 disposed at openings of cooling passages 32A, 32B are controlled so as to adjust an air amount to be sufficient for one of the cooling passages. Arrangement of partition wall 14 between canisters 2 stacked in storage tubes 6 restricts convection of gas in storage tubes 6 within the area where only one canister 2 is arranged, wherein the convection is caused by heating of decay heat generated vitrification body 1 and canister 2. Thus, a temperature increase at the upper portion of storage tubes 6 is restricted and a temperature distribution in the axial direction of storage tubes 6 becomes more constant. Since partition wall 14 is of thermal insulating material, heat transfer through partition wall 14 is little.

Storage tubes 6 expand in the axial direction due to heating by decay heat of radioactive materials. A space which absorbs thermal expansion in the axial direction of storage tubes is formed between the lower end of storage tubes 6 and floor slab 8, i.e. the lower end of storage tubes 6 and the bottom face of cylindrical vibration limiting member 16. Since thermal expansion to downward direction is not suppressed, damage, such as fracture, to storage tubes 6 is avoided.

Vibration limiting member 16 suppresses horizontal vibration of the lower portions of storage tubes 6 at the time of earthquakes.

Storage tubes 6 have pads 17 at positions where horizontal partition wall 10 and vibration limiting member 16 face each other. Pads 17 increase mechanical strength of the structure, and it is possible to prevent deformation of storage tubes 6 due to collision of middle vibration limiting member 15 and limiting member 16 at the time of earthquakes.

Relatively large, heavy articles among dust and substances contained in air flowing into entrance duct 19 from air intake port 11 come to pit 20 formed at the lower part of entrance duct 19. Since entrance openings 30A, 30B are located above pit 20, they are not clogged by the articles. Cleaning robot 21 cleans pit 20 at certain intervals, and it discharges the articles.

Relatively light dust, etc. contained in air flowing into entrance duct 19 from air intake port 11 enter cooling passages 32A, 32B and adhere to outer faces of storage tubes 6. This makes cooling effect lower of storage tubes 6 by cooling air. Therefore, it is necessary to remove dust adhered to storage tubes 6. Since corroded surfaces of storage tubes 6 may decrease heat-removing effect, polishing of outer faces of storage tubes 6 may be necessary in some instances. When heavy corrosion of storage tubes 6 takes place, it may be proposed to repair storage tubes 6 by welding. For this purpose, the robot for maintenance and inspection is installed as described before. The robot travels at certain intervals along traveling rails 33, and inspection section 35 inspects the outer faces of storage tubes 6. When corrosion is detected, repair is carried out by the robot.

The use of canisters 2 is not always necessary at the time when radioactive waste are filled in storage tubes 6. However, canisters 2 serve as a barrier for confining radioactive waste. When canisters 2 are made of boron containing alloys such as boron containing stainless steels or boron containing aluminium alloys, neutron absorbing capacity of the alloys serves to criticality control.

The following accomodation of radioactive waste in storage tubes 6 is proposed from the view point of cooling of radioactive waste and a temperature distribution of storage tubes 6.

First of all, canisters 2 acommodating radioactive waste of quantity of heat generation brought in a dry storage facility for an vitrification body 1 are accomodated in storage tubes 6 one by one from storage tubes 6 located near exit openings 31A, 31B of cooling passage to storage tubes 6 located near entrance openings 30A, 30B. As a result, canisters 2, etc. accomodating radioactive waste of large heat generation that are just brought into dry storage facility 38 are stored one by one from downstream side of cooling passages 32A, 32B. Accordingly, radioactive waste with large quantity of heat generation is always placed in storage tubes 6 at the most upper stream side. Radioactive waste with large quantity of heat generation just brought into the dry storage facility 38 are cooled by cooling air of the lowest temperature. This is very convenient for cooling radioactive waste.

Radioactive waste with large quantity of heat generation accomodated in storage tubes 6 is cooled with high effeciency by cooling air of low temperatures. As time laps, radioactive waste accomodated in storage tubes 6 located near exit openings 31A, 31B decrease quantity of heat generation, and it is possible to carry out cooling by the cooling air that temperature rose by cooling of storage tubes 6 accomodating canister in the upper stream side.

By adopting such the storage method mentioned above, without transferring the radioactive waste according to quantity of heat generation, radioactive waste of large quantity of heat generation that are brought in dry storage facility 38 are accomodated in storage tubes of upper stream side in early time, but radioactive waste with small quantity of heat generation are accomodated in the storage tubes in downstream side.

According to another storage method, the upper part of storage tubes 6 where temperatures become potentially higher accomodates radioactive waste of smaller quantity of heat generation (in a state accomodated in canister 2) than radioactive waste accomodated in the lower part. The above mentioned storage methods can be applied to a dry storage facility in which the horizontal partition wall 10 is not disposed, as shown in FIG. 1 of Japanese patent laid-open print No. 2-17500 bulletin.

Another example of a canister and storage tubes is explained bellow.

In the conventional technique, when spent fuel assemblies are transported from a radioactive waste dry storage facility to a re-processing plant, a canisters must be opened to take out the spent fuel assemblies to transfer them to a transportation cask. This increases an amount of work. In order to solve this problem, the canister and storage tubes shown in FIG. 5 were proposed. Canister 2 has a container portion for accomodating radioactive waste and a lid for sealing up the container. The container of canister 2 and the sectional shape of the lid of this example are square shaped. The sectional shape of storage tubes 6 for accomodating canister 2 is also square shaped. Corner portions are deformed thereby to reduce loosening.

Four small spent fuel assemblies 4 are accomodated in canister 2. Besides small spent fuel assemblies 4, large size spent fuel assemblies 3 mentioned above and spent fuel rods 5 disassembled from spent fuel assemblies may be accomodated. Canister 2 of this type is suitable to be loaded as it is in the spent fuel transportation cask. As materials of canister 2, copper or copper alloys are used from the view point of thermal conductivity.

Because the sectional shape of canister 2 of this example is square, useless spaces can be reduced when spent fuel assemblies are accomodated. For this reason, the space efficiency of the canister can be improved. In this example, canister 2 accomodating radioactive waste was loaded as being sealed state in the spent fuel transportation cask, and the canister is carried out from the dry storage facility. Thus, carrying out of radioactive waste from storage tubes can be done in short time.

Figure 5:
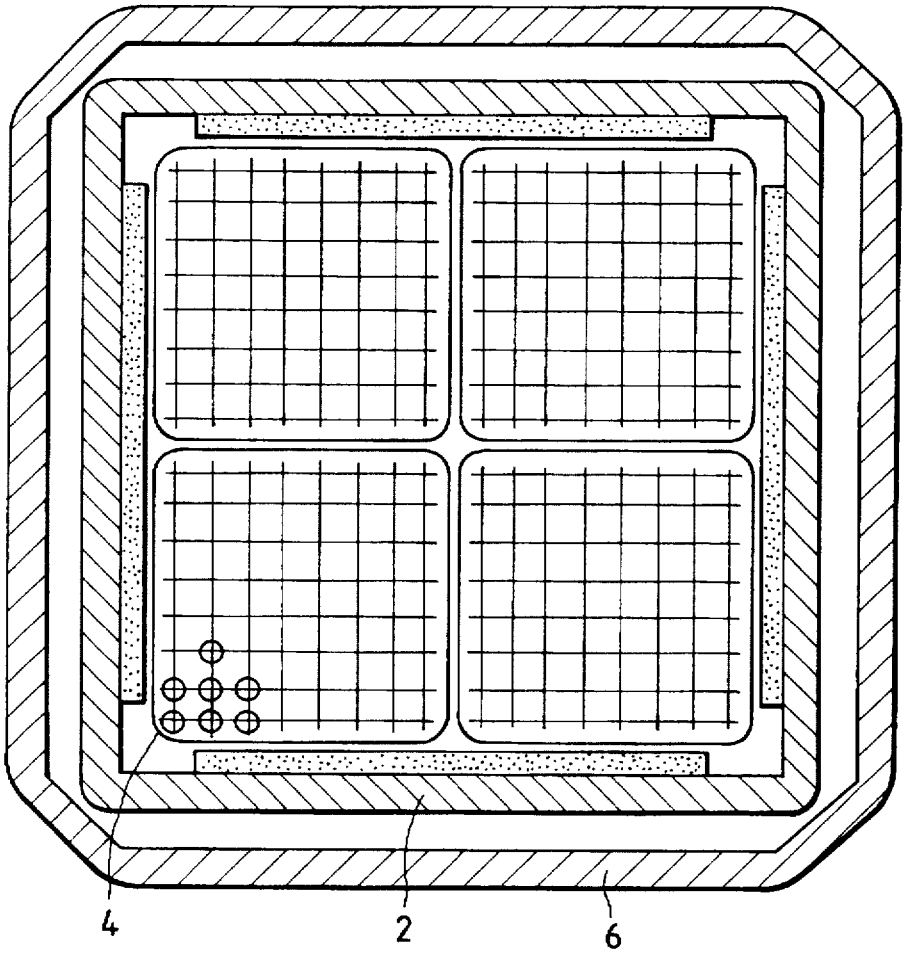
FIG. 5 is a horizontal sectional view of a canister and a storage tube in another example.
Figure 6:
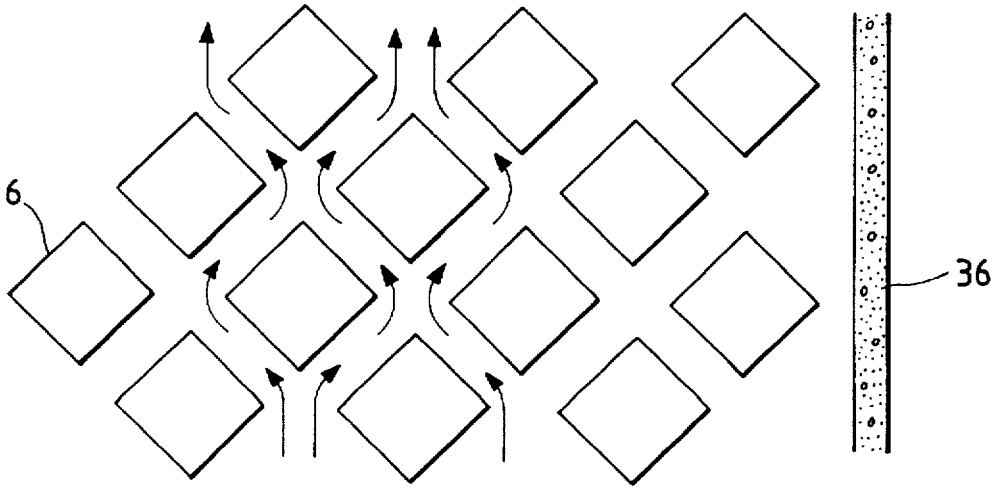
FIG. 6 is an illustrating figure for showing arrangement of storage tubes.

Storage tubes of FIG. 5 are arranged in the manner shown in FIG. 6 where angle corners of the storage tubes are directed to entrance of cooling air. In other words, angles of storage tube 6 face side wall 36. Because angle corners of storage tubes 6 are arranged toward the entrance direction of the cooling passage, resistance of storage tubes 6 against a flow of cooling air becomes smaller and a pressure loss of cooling passage can be reduced. When a sectional shape of storage tubes is circular, cooling air stagnates in the cooling passage formed between the storage tubes. There is a flow of cooling air which does not contribute to cooling. In this example, because a sectional shape of storage tubes 6 is a square, a width of cooling passages formed between adjacent storage tubes 6 can be set up uniformly. On this account, stagnation of cooling air flow becomes little and cooling ability for storage tubes 6 can be improved.

Furthermore, because sectional shapes of canister 2 and storage tubes 6 is square, a width of the gap formed between storage tubes 6 and canister 2 is formed uniformly, and the cooling efficiency of radioactive waste is improved.

A sectional shape of canister 2 and storage tubes 6 may be formed in a hexagonal shape. In particular, when the spent fuel rods disassembled from spent fuel assembly 5 are accomodated in the canister that has a sectional shape of hexagonal shape 2, a compact structure is obtained. The canister of this type is suitable to be loaded as it is to the spent fuel transportation cask. In this case, the sectional shape of storage tubes 6 should also be a hexagonal shape from the view point of heat dissipation.

Figure 7:
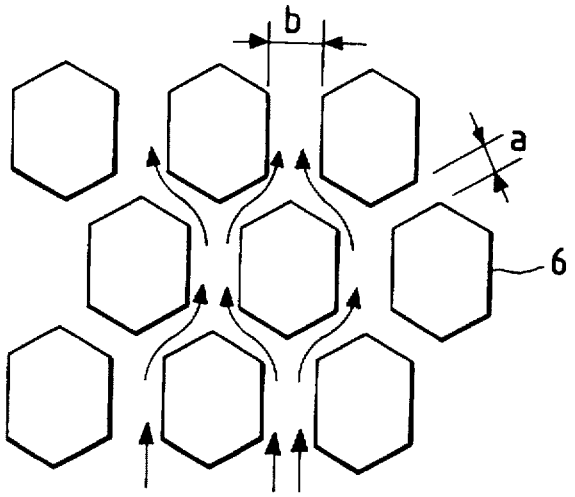
FIG. 7 is an illustrating figure for showing arrangement of storage tubes in another example.

As shown in FIG. 7, corners of storage tubes 6 of a hexagonal shape are arranged toward entrance of cooling air of cooling passages. These storage tubes 6 are arranged in a triangular array form. In these storage tubes 6, one of the three diagonals is longer than the others, as shown in FIG. 7. The longest diagonal is directed to the entrance of cooling air, and the length b is 1.5 to 2.5 times the length of a. Thus, areas between storage tubes 6 are made uniform and pressure loss of cooling passages becomes small.

When sectional shapes of canister 2 and storage tubes 6 are hexagonal, the same result as FIG. 5 is obtained.

Figure 8:
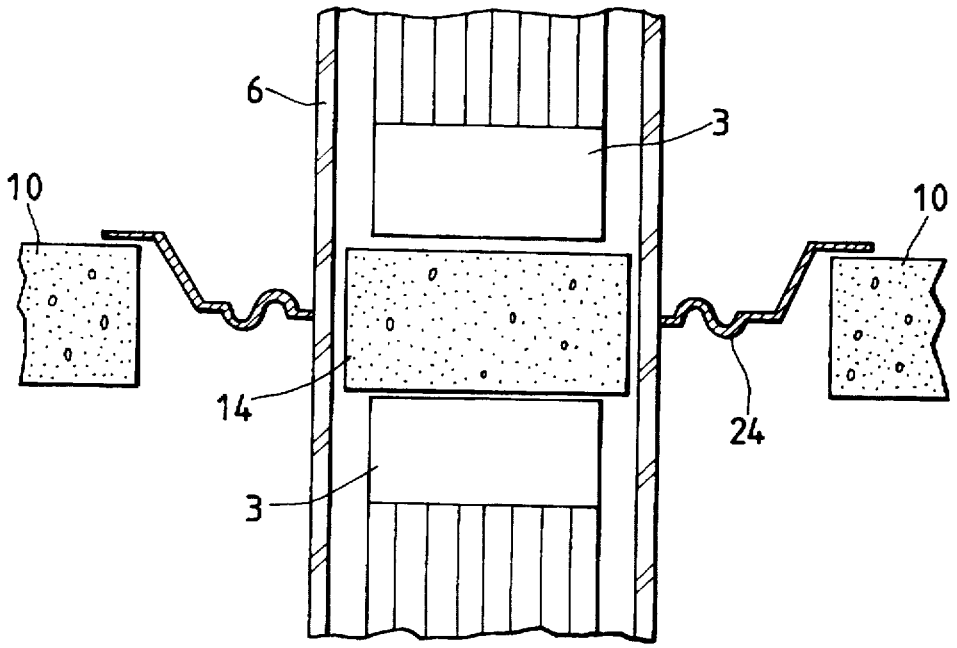
FIG. 8 is a vertical sectional view of a part arround a horizontal partition wall and a storage tube in another example.

FIG. 8 shows another example of a vicinity of storage tubes 6 and horizontal partition wall 10 in the example of FIG. 1. In this example, bellows 24 is provided between pad 17 disposed to storage tubes 6 and horizontal partition wall 10. Bellows 24 is joined to storage tubes 6 so that a leak of cooling air is prevented and vibration in the width direction can be absorbed at the time of earthquakes. Heat stress occurring to storage tube 6 is small in this construction. The structure is applied to the case where thermal stress occurring in storage tubes 6 is small and where prevention of leak of cooling air through the gap between storage tubes 6 and horizontal partition wall 10 secures a thermal balance between upper and lower cooling passages with respect to heat removal. According to this example, vibration in a horizontal direction of storage tube 6 is restrained to improve anti-earthquake property.

Figure 9:
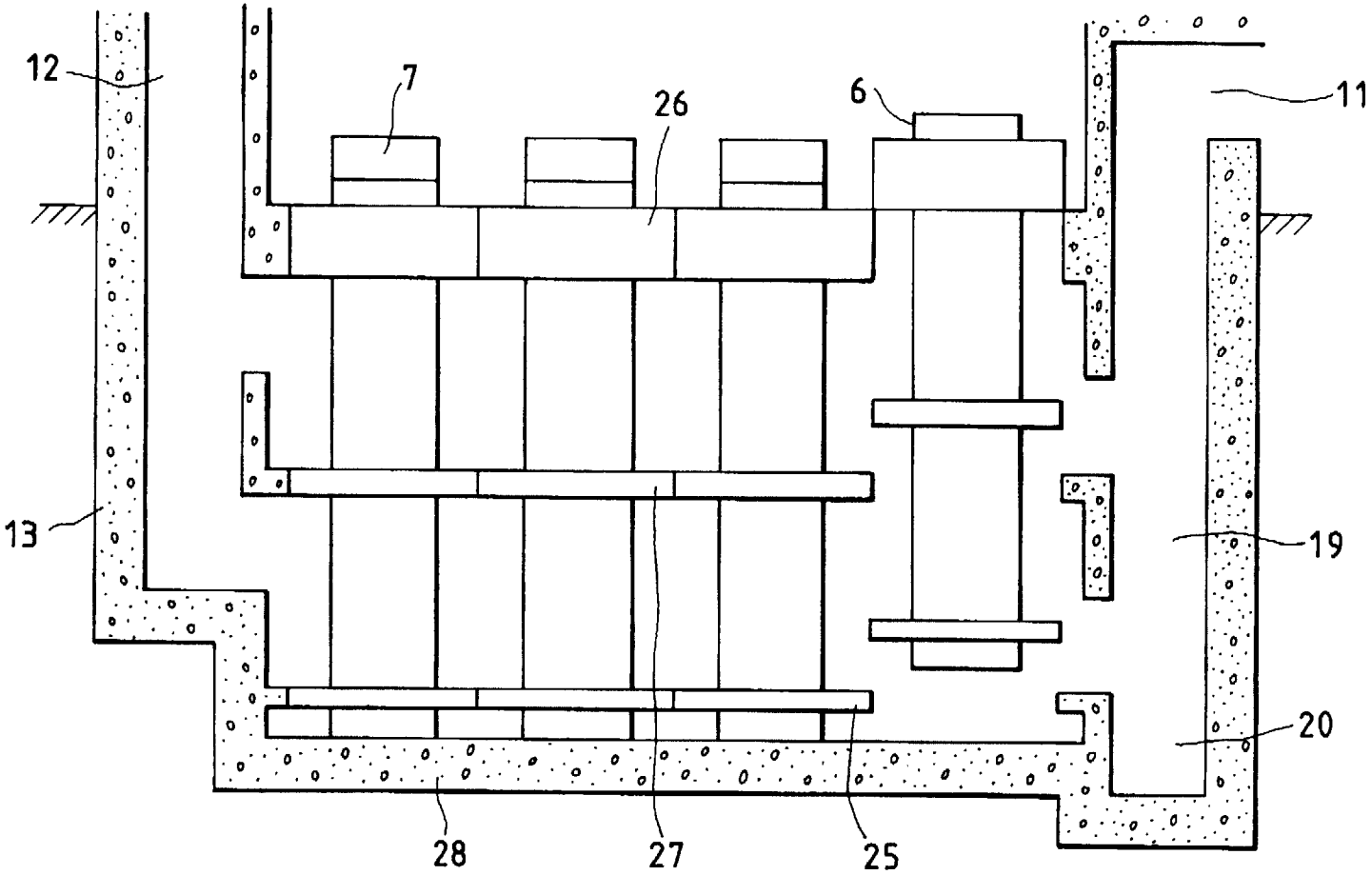
FIGS. 9, 11 and 12 are vertical sectional views of dry radioactive waste storage facility in other examples.

FIG. 9 shows another example of a radioactive waste dry storage plant of this invention. In this example, floor slab 8, ceiling slab 9 and horizontal partition wall 10, those being shown in FIG. 1, are divided into a plurality of elements. Other parts of this example are the same as in FIG. 1.

Storage tubes 6 used in this example have floor slab element 25, partition wall element 27 and ceiling slab element 26, arranged in axial direction. Storage tubes 6 having the elements are arranged on bulding floor 28 in such a manner that floor slab 25, partition member 27 and ceiling slab 26 are juxtaposed each other.

Figure 10:
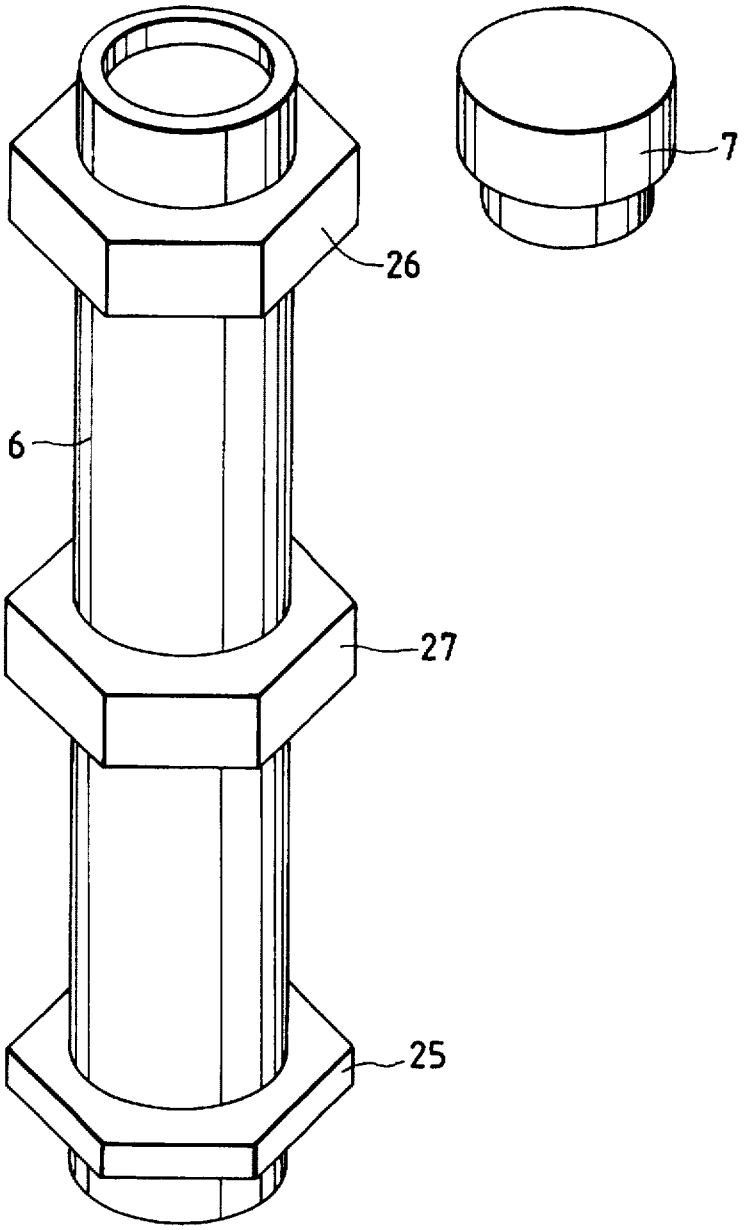
FIG. 10 is a perspective view of a storage tube.

FIG. 10 shows a perspective view of this example. In this example, storage tubes 6 are arranged in triangle array so that floor slab element 25, partition wall element 27 and ceiling slab element 26 are formed in a hexagonal shape. But, when storage tubes 6 are arranged in a square array form, those elements become square shape. In this example, compared to the example of FIG. 1, the structure of dry storage facility becomes more simplified.

Figure 11:
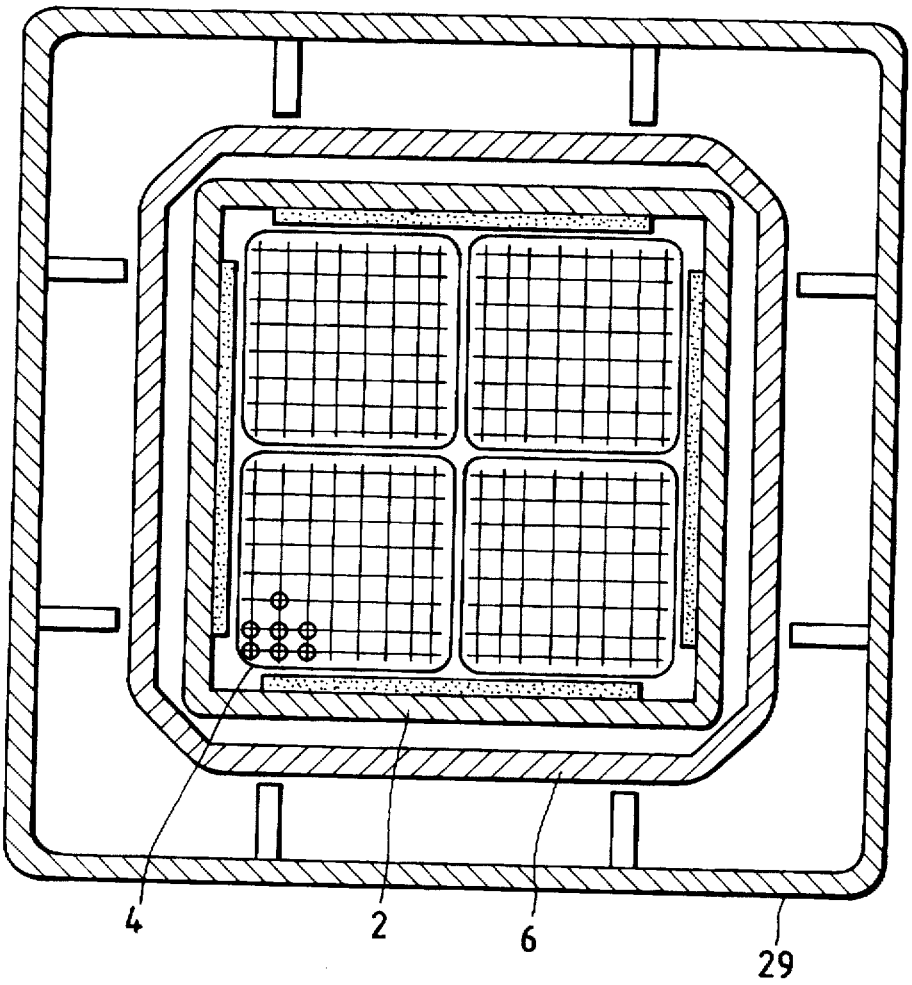

Another example of the dry storage facility to which the structure of FIG. 5 is applied is shown to FIG. 11. In this example, outer pipes 29 are disposed to surround storage tubes 6 of which a sectional shape is square, and cooling passages extending in the direction of the storage tube 6 are formed between storage tubes 6 and outer pipes 29. According to this example, canisters and storage tubes shown in Japanese utility model patent laid-open print No. 62-22600 are substituted by the structure shown in FIG. 11. Canisters 2 used in this example can be loaded as they are in a used fuel transportation cask, and four small spent fuel assemblies 4 can be accomodated therein. Outer pipes 29 that adopt the square similar figure are arranged in square array form. The sectional shape of outer pipe 29 can be formed in a hexagonal shape. In this case, outer pipes 29 can be arranged in a triangle array form. This canisters 2 can accomodate spent fuel rods 5 disassembled from spent fuel assembly and large size spent fuel assembly 3, too.

Figure 12:
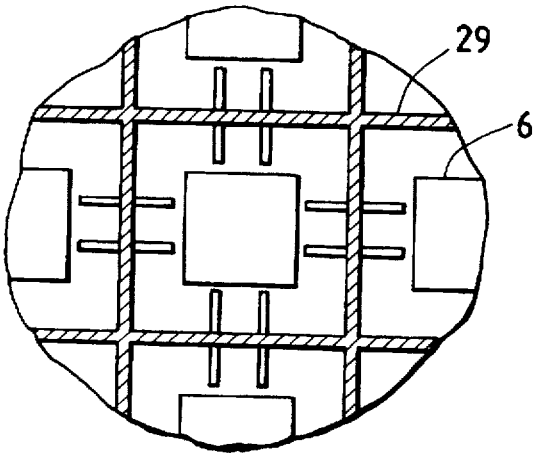

As is exemplified in FIG. 12, it is possible to partition by a single wall adjacent cooling passages where cooling air flows in the axial direction of the bandled outer pipes 29 as one body. The dry storage facility of this structure can be compacted, besides securing the sectional flow area of the cooling passages necessary for cooling by cooling air. Same as the example of FIG. 1, acommodating the radioactive waste with low heat generation on the upper part of storage tubes 6 is suitable for keeping low the maximum temperature of the canisters and claddings of spent fuel.

According to the invention, because a temperature rise of cooling gas in the cooling passages above the partition member is controlled, cooling of storage tubes in the cooling passage above the partition is cooled with high effeciency. Accordingly, by a simple construction in which partition member is arranged, temperature distribution in the axis direction of storage tubes can be more uniformed.

What is claimed is:

1. A radioactive waste dry storage facility comprising;

a first slab, a second slab located below the first slab for forming a passage through which cooling gas flows between the first slab and the second slab, a plurality of storage tubes installed in the first slab and extending in the passage toward the second slab, which accomodate canisters for accomodating radioactive waste therein, and partition members arranged between the first slab and the second slab thereby to divide the cooling gas passage into a plurality of cooling passages in top and bottom directions, wherein each of the storage tubes penetrates the partition member.

2. The radioactive waste dry storage facility according to claim 1, wherein a height of the canister is almost equal to that of each of the cooling passages.

3. The radioactive waste dry storage facility according to claim 1, which further comprises vibration limiting means disposed to the second slab and located at the circumference of a lower end of the storage tube, wherein the vibration limiting means limits vibration of a width direction of the lower end of the storage tube.

4. The radioactive waste dry storage facility according to claim 3, which further comprises a pad disposed to each part of the storage tubes facing the partition member and said vibration limiting means.

5. The radioactive waste dry storage facility according to claim 1, further comprising a gap formed between the partition member and the storage tube.

6. The radioactive waste dry storage facility according to claim 1, further comprising a gap formed between a lower edge of the storage tube and the second slab, whereby heat expansion in an axis direction of the storage tube is absorbed.

7. The radioactive waste dry storage facility according to claim 1, further comprising a deformable supporting member for suppressing vibration of the storage tubes in a horizontal direction disposed between each of the storage tubes and each of the partition members.

8. The radioactive waste dry storage facility according to claim 1, wherein the partition member is of a thermal insulating material.

9. The radioactive waste dry storage facility according to claim 8, wherein the partition member is of concrete.

10. The radioactive waste dry storage facility according to claim 8, wherein the partition member is of stainless steel.

11. The radioactive waste dry storage facility according to claim 1, wherein each of the cooling passages is disposed underground and its inlet and exit communicate with the atmosphere on the ground.

12. The radioactive waste dry storage facility according to claim 11, further comprising cleaning means for cleaning the inside of an air intake pit which communicates an entrance and the atmosphere of each of the cooling passages.

13. The radioactive waste dry storage facility according to claim 12, wherein the cleaning means is a robot.

14. The radioactive waste dry storage facility according to claim 1, further comprising a convection suppressing member disposed between the canisters accomodated in an axial direction of the storage tubes.

15. The radioactive waste dry storage facility according to claim 14, wherein the convection suppressing member is of a thermal insulating material.

16. The radioactive waste dry storage facility according to claim 1, wherein the partition member is a partition element disposed to each of the storage tubes.

17. The radioactive waste dry storage facility according to claim 1, wherein the first slab is composed of a first slab element disposed to each of the storage tubes.

18. The radioactive waste dry storage facility according to claim 1, further comprising flow quantity regulation means for regulating a flow quantity of cooling gas disposed to each of the cooling passages.

19. The radioactive waste dry storage facility according to claim 1, wherein a sectional shape of the storage tubes is polygonal, and a corner of the sectional shape is arranged toward an entrance of the cooling passages.

20. The radioactive waste dry storage facility according to claim 19, wherein the sectional shape of the storage tubes is square or hexagonal.

21. The radioactive waste dry storage facility according to claim 19, wherein a sectional shape of the canister accomodated in the storage tubes is formed substantially similar in shape with the sectional shape of the storage tubes.

22. The radioactive waste dry storage facility according to claim 1, which further comprises maintenance and inspection means that moves between the storage tubes in the cooling passages for carrying out maintenance and inspection of outside of the storage tubes.

23. A method of carrying radioactive waste out from a radioactive waste dry storage facility comprising a first slab; a second slab located below the first slab for forming a passage through which cooling gas flows between the first slab and the second slab; a plurality of storage tubes installed in the first slab and extending in the passage towards the second slab which accommodate canisters which contain radioactive waste therein; and partition members arranged between the first slab and the second slab thereby to divide the cooling gas passage into a plurality of cooling passages in top and bottom directions, wherein each of the storage tubes penetrates the partition member, which comprises the steps of: taking out the canisters from the storage tube, loading the canisters which are sealed up in a transportation cask, and bringing out the cask from the radioactive waste dry storage facility.

24. A method of storing radioactive waste in dry state in a radioactive waste dry storage facility comprising a first slab; a second slab located below the first slab for forming a passage through which cooling gas flows between the first slab and the second slab; a plurality of storage tubes installed in the first slab and extending in the passage towards the second slab, which accommodate canisters which contain radioactive waste therein; and partition members arranged between the first slab and the second slab thereby to divide the cooling gas passage into a plurality of cooling passages in top and bottom directions, wherein each of the storage tubes penetrates the partition member, which comprises the steps of: accommodating said canisters one by one in the storage tube located near an exit of said cooling gas passage, and storing the canisters one by one in the storage tube toward an entrance of the cooling gas passage.

25. A method of storing radioactive waste in dry state in a radioactive waste dry storage facility comprising a first slab; a second slab located below the first slab for forming a passage through which cooling gas flows between the first slab and the second slab; a plurality of storage tubes installed in the first slab and extending in the passage towards the second slab, which accommodate canisters which contain radioactive waste therein; and partition members arranged between the first slab and the second slab thereby to divide the cooling gas passage into a plurality of cooling passages in top and bottom directions, wherein each of the storage tubes penetrates the partition member, which comprises the steps of arranging a canister containing radioactive waste with a higher heat generation at a lower part of the storage tube, and arranging another canister containing radioactive waste with a lower heat generation at an upper part of the storage tube.

* * * * *